United States Patent [19]

Waghorn et al.

[11] 4,367,002

[45] Jan. 4, 1983

[54] COUPLING RING HAVING LINED BAYONET SLOT

[75] Inventors: Robert D. Waghorn, Oneonta; Robert W. Brush, Jr., Sidney, both of N.Y.

[73] Assignee: The Bendix Corporation, Southfield, Mich.

[21] Appl. No.: 206,791

[22] Filed: Nov. 14, 1980

[51] Int. Cl.[3] ..... H01R 13/625

[52] U.S. Cl. ..... 339/90 R; 339/DIG. 2

[58] Field of Search ..... 339/DIG. 2, 89 R, 89 C, 339/89 M, 90 R, 90 C; 285/39 L

[56] References Cited

U.S. PATENT DOCUMENTS

| | | | |
|---|---|---|---|
| 2,923,909 | 2/1960 | Modrey | 339/90 R |
| 3,221,790 | 12/1965 | Poupitch | 151/7 |
| 3,262,480 | 7/1966 | Storch | 151/7 |
| 3,286,578 | 11/1966 | Fiddler | 85/36 |
| 3,388,627 | 6/1968 | Tinnerman | 85/32 |
| 3,393,927 | 7/1968 | Kelly et al. | 285/23 |
| 3,455,580 | 7/1969 | Howard | 339/90 R |
| 3,468,212 | 9/1969 | Tinnerman | 85/32 |
| 3,551,880 | 12/1970 | Hartwell | 339/89 |
| 3,805,379 | 4/1974 | Vetter | 29/629 |
| 4,305,180 | 12/1981 | Schwartz | 339/90 R |

*Primary Examiner*—John McQuade

*Attorney, Agent, or Firm*—Raymond J. Eifler

[57] ABSTRACT

The invention is a plastic coupling ring 20 that has along the sides of a groove 21 in the forward mating portion thereof a metal liner 10 that protects the sides of the groove 21 when it is mated with the bayonet pin on another connector housing.

5 Claims, 5 Drawing Figures

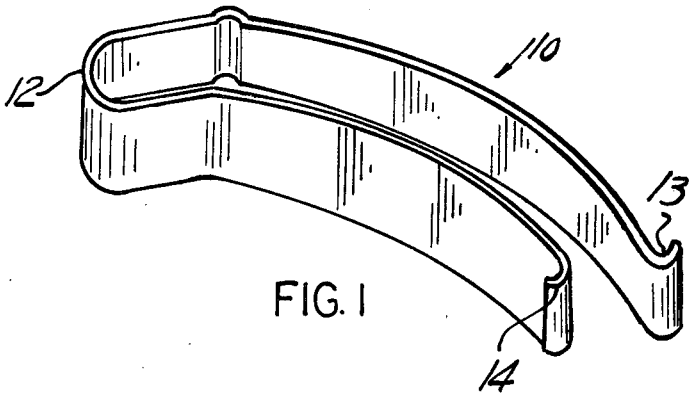
FIG. 1
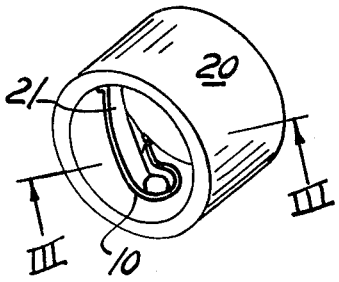
FIG. 2
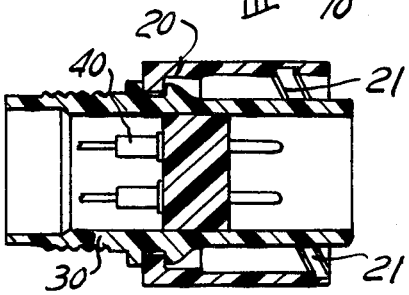
FIG. 5
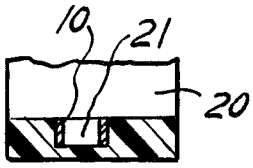
FIG. 3
FIG. 4
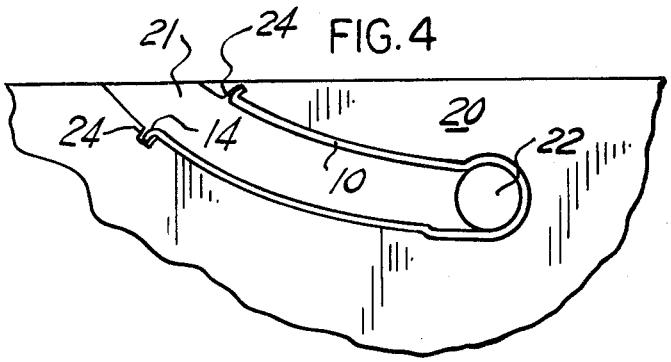

COUPLING RING HAVING LINED BAYONET SLOT

This invention relates to an electrical connector assembly of the type having a bayonet coupling.

An electrical connector assembly is generally comprised of two separate housings connected together by a coupling member mounted on one of the housings. In bayonet type couplings, the coupling member on one housing includes an internal groove which mates with a pin on the other housing so that when the coupling member is rotated, the housings are drawn together. An example of electrical connectors having such bayonet type couplings may be found in U.S. Pat. Nos. 3,551,880, issued Dec. 29, 1970 and entitled "Electrical Connector Having An Improved Locking Means"; 3,805,379, issued Apr. 23, 1974 and entitled "Method of Assembling An Electrical Connector to Effect A Preloading Thereof"; and 3,393,927, issued July 23, 1968 and entitled "Electrical Connector". In all of the foregoing patents, the grooves in the coupling ring described therein are subjected to wear during mating with the pin on the other housing. This is especially true in a connector assembly comprised of plastic as is shown in U.S. Pat. No. 3,551,880.

DISCLOSURE OF THE INVENTION

The invention is a coupling member for connector assembly that includes a novel means for reducing wear in the side of a groove in the coupling member. An electrical connector employing the invention is characterized by a coupling member having a strip of metal mounted in and along the sides of the groove in the forward mating portion of the coupling member.

Accordingly, one advantage of the invention is that it extends the useful life of a plastic coupling ring.

Another advantage of the invention is that it protects the sides of the groove in the plastic coupling ring.

DETAILED DESCRIPTION OF THE INVENTION

FIG. 1 illustrates a strip of metal.

FIG. 2 illustrates a coupling member utilizing the principles of the invention.

FIG. 3 illustrates a cross-sectional view of the groove in the coupling member shown in FIG. 2.

FIG. 4 is an enlarged view of the metal strip in the coupling ring groove.

FIG. 5 illustrates an electrical connector assembly utilizing the principles of this invention.

Referring now to the drawings, FIG. 1 illustrates a strip of metal that may be comprised of beryllium copper or brass. The strip of metal 10 is folded over to include a rounded portion 12 and two ends 13 and 14 that are curved outwardly.

FIG. 2 illustrates a coupling member 20 that is comprised of a plastic. The coupling member 20 includes a groove 21 having mounted along the sides thereof a strip of metal 10.

FIG. 3 is a cross-sectional view of the groove in the coupling member 20 shown in FIG. 2 and illustrates how the metal strip 10 is press fit or molded into the sides of the groove.

FIG. 4 illustrates the metal strip 10 in the groove 21 with the curved end portions 13 and 14 of the metal strip located in recesses 24 in the sides of the groove 21 to prevent the metal strip from moving out of the groove.

FIG. 5 illustrates a connector assembly which includes a housing 30, contacts 40 mounted within the housing and the coupling ring 20 shown in FIG. 2.

While a preferred embodiment of the invention has been disclosed, it will be apparent to those skilled in the art that certain changes may be made to the invention as set forth in the appended claims, and in some instances, certain features of the invention may be used to advantage without corresponding use of other features. Accordingly, it is intended that the illustrative and descriptive materials herein be used to illustrate the principles of the invention and not to limit the scope thereof.

Having described the invention what is claimed is:

1. In combination with an electrical connector of the type having: a plastic housing having a central axis, a forward portion, and a rear portion; at least one electrical contact mounted in said housing; and a tubular coupling member comprised of plastic and mounted to and disposed around a portion of said housing, said coupling member having a rear portion and a forward mating portion having a groove on the inside thereof, said coupling member adapted to connect to a similar housing having at least one contact adapted to mate with said contact in said housing, the improvement wherein the forward mating portion of said coupling member includes:

a strip of metal mounted in and along the sides of said groove on the inside of said coupling member.

2. The electrical connector as recited in claim 1 wherein at least one wall of said groove includes a recess adjacent to the forward end of the coupling member and wherein said metal strip includes a curved end that extends into said recess.

3. In combination with an electrical connector of the type having a first housing having a forward portion; a plurality of electrical contacts mounted in said first housing, each of said contacts having a mating portion located in said forward portion of said first housing; and a coupling member comprised of plastic and mounted to said first housing, said coupling member having a forward mating portion having a groove on the inside thereof, said housing and said coupling member adapted to mate with a second housing having a central axis, a forward mating portion, a plurality of electrical contacts mounted in said second housing each of said contacts having a mating portion located in said forward portion of said second housing and adapted to mate with the contacts in said first housing, and a member projecting radially outward from the outside surface of the forward mating portion of said second housing, said member adapted to mate with the groove on the inside forward mating portion of said coupling member, the improvement wherein the forward mating portion of the coupling member includes:

a strip of metal mounted in and along the sides of the groove in the forward mating portion of said coupling member.

4. The combination as recited in claim 3 wherein said housings and coupling member are cylindrical and said coupling member is rotatably mounted to said first housing.

5. The electrical connector as recited in claim 3 wherein at least one wall of said groove includes a recess adjacent the forward end of the coupling member and wherein said metal strip includes a curved end that extends into said recess.

* * * * *